US012168587B2

(12) United States Patent
Fusar Poli et al.

(10) Patent No.: US 12,168,587 B2
(45) Date of Patent: Dec. 17, 2024

(54) FOLDING APPARATUS FOR A CONTINUOUS WEB

(71) Applicant: GDM S.p.A., Bologna (IT)

(72) Inventors: Aldo Fusar Poli, Offanengo (IT); Marco Rosani, Vailarate (IT); Matteo Piantoni, Albino (IT)

(73) Assignee: GDM S.P.A., Bologna (IT)

( * ) Notice: Subject to any disclaimer, the term of this patent is extended or adjusted under 35 U.S.C. 154(b) by 1081 days.

(21) Appl. No.: 17/052,358

(22) PCT Filed: May 7, 2019

(86) PCT No.: PCT/IB2019/053727
§ 371 (c)(1),
(2) Date: Nov. 2, 2020

(87) PCT Pub. No.: WO2019/215607
PCT Pub. Date: Nov. 14, 2019

(65) Prior Publication Data

US 2021/0171310 A1 Jun. 10, 2021

(30) Foreign Application Priority Data

May 7, 2018 (IT) ..... 102018000005103

(51) Int. Cl.
*B65H 37/06* (2006.01)
*B65H 20/06* (2006.01)

(52) U.S. Cl.
CPC ..... *B65H 37/06* (2013.01); *B65H 20/06* (2013.01)

(58) Field of Classification Search
CPC ..... B65H 45/08; B65H 45/09; B65H 45/22; B65H 20/06; B65H 37/06; A61F 13/15682
(Continued)

(56) References Cited

U.S. PATENT DOCUMENTS 2,956,799 A 10/1960 Wasson
5,090,672 A * 2/1992 Ballestrazzi ..... B65H 45/22 270/32
(Continued)

FOREIGN PATENT DOCUMENTS

CH 555776 A 11/1974
CN 102821725 A 12/2012
(Continued)

OTHER PUBLICATIONS

Japanese Office Action dated Dec. 20, 2022 from counterpart Japanese Patent Application No. 2020-562746.
(Continued)

*Primary Examiner* — Leslie A Nicholson, III
(74) *Attorney, Agent, or Firm* — SHUTTLEWORTH & INGERSOLL, PLC; Timothy J. Klima

(57) ABSTRACT

A folding apparatus for a continuous web for production of absorbent hygiene articles and intended to be folded into a "V" or "U" shape in first and second longitudinal portions along a folding line parallel to a feeding line. A folding section includes a contact unit extending along the feeding line and defining the folding line. First and second guides are positioned on opposite sides of the contact unit and respectively have first and second sliding surfaces. The first and second sliding surfaces extend in a helical fashion along the feeding line, each having a respective infeed section, where the web is not folded, and a respective outfeed section, positioned downstream of the respective infeed section according to a web feeding direction, where the web is folded in two and has the first portion and the second portion set at an angle to each other.

8 Claims, 3 Drawing Sheets

(58) Field of Classification Search
USPC ..... 270/41
See application file for complete search history.

(56) References Cited

U.S. PATENT DOCUMENTS

| | | | | |
|---|---|---|---|---|
| 5,807,228 | A | 9/1998 | Smithe et al. | |
| 6,821,240 | B1 | 11/2004 | Ruckmann et al. | |
| 7,591,809 | B2 * | 9/2009 | Mizutani ..... | A61F 13/15211 156/204 |
| 11,447,361 | B2 * | 9/2022 | Fusar Poli ..... | B65H 23/032 |
| 2010/0168708 | A1 | 7/2010 | Umebayashi et al. | |

FOREIGN PATENT DOCUMENTS

| | | | |
|---|---|---|---|
| CN | 203593460 | U | 5/2014 |
| CN | 204223929 | U | 3/2015 |
| DE | 2146013 | A1 | 3/1973 |
| DE | 2241609 | A1 | 5/1973 |
| GB | 2196657 | A | 5/1988 |
| JP | S6141716 | | 11/1986 |
| JP | 2004141626 | A | 5/2004 |
| WO | 2015046157 | | 2/2015 |

OTHER PUBLICATIONS

International Search Report and Written Opinion dated Jul. 30, 2019 from counterpart International Patent Application No. PCT/IB2019/053727.
Chinese Office Action dated Jan. 11, 2022 from conterpart Chinese Patent Application No. 2019800303908.

* cited by examiner

FOLDING APPARATUS FOR A CONTINUOUS WEB

This application is the National Phase of International Application PCT/IB2019/053727 filed May 7, 2019 which designated the U.S.

This application claims priority to Italian Patent Application No. 102018000005103 filed May 7, 2018, which application is incorporated by reference herein.

TECHNICAL FIELD

This description relates to a folder or folding apparatus for a continuous web and in particular an apparatus for folding in two a continuous composite web intended for making products of the absorbent hygiene article type, for example nappies or incontinence pants.

BACKGROUND ART

During the production of nappies or incontinence pants, for example those wearable like pants, a semi-finished product, in the form of a composite web, usually comprising multiple components which have been assembled, is folded in two according to a longitudinal folding line.

In that case, what is always wanted is for the longitudinal edges of the web, which following folding are superposed, to be in a precise position relative to each other, for example aligned.

In this context, the technical purpose which forms the basis of this description is to propose a folding apparatus for a composite web which allows the longitudinal edges of a web, once the web has been folded in two, to be positioned in a predetermined position relative to each other, for example aligned.

DISCLOSURE OF THE INVENTION

The aim of this description is to propose a folding apparatus for a web which is being fed along a plant for the production or manufacture of absorbent hygiene articles, which is reliable for positioning the longitudinal edges of the web relative to each other, once the web has been folded.

The technical purpose indicated and at least the aim specified are substantially achieved by a folding apparatus according to one or more of the appended claims.

According to one aspect of the description, the description relates to a folding apparatus for a continuous web being fed in a plant for manufacturing absorbent hygiene articles.

The continuous web is preferably folded in a transversal direction according to a longitudinal folding line parallel to a web feeding line.

According to one aspect of the description the apparatus is also preferably equipped for positioning the longitudinal edges of the web in a predetermined position relative to each other, once the web has been folded.

According to one aspect of the description, the folding apparatus comprises a folding section where the web is folded in two according to a longitudinal folding line.

According to one aspect of the description, the web is folded, for example, in such a way that the opposite longitudinal edges of the self-same web are superposed at the end of folding.

The folding apparatus according to this description comprises a folding section where folding of the web effectively takes place.

Folding can occur, in use, because the web passes in the folding section.

According to one aspect of the description, the folding apparatus comprises a feeding system for the continuous web, preferably folded, located downstream of the folding section according to the web feeding direction.

The folding line is defined by a contact unit for the web which is part of the folding section.

According to one aspect of the description, the folding section comprises a first guide and a second guide which are located on opposite sides of the contact unit and respectively having a first sliding surface for the continuous web and a second sliding surface for the continuous web.

The first sliding surface of the first guide and the second sliding surface of the second guide extend in a helical fashion and are preferably specular relative to a lying plane of the folding line.

The web being fed along the guides passes from a spread out, open configuration, to a transversally folded configuration, with two longitudinal flaps side by side and separated by the folding line.

Folding of the web is preferably guided by the guides from start to finish, therefore it is extremely precise.

According to one aspect of the description, the sliding surfaces have a substantially flat and horizontal infeed section and a substantially flat and vertical outfeed section.

The sliding surfaces converge from the infeed section towards the outfeed section in such a way that the web fed preferably folded downstream, reaches the folded configuration along the guides.

According to one aspect of the description, the position of the guides is adjustable around an axis of rotation which is transversal, for example perpendicular, to the feeding line, for controlling the relative position of the longitudinal edges of the web once it has been folded.

The position of the guides relative to the axis of rotation is preferably controlled using feedback by means of a position sensor which checks the relative positioning of the edges of the web and sends a corresponding control signal to a computerised control unit which by means of a respective actuator adjusts the position of the guides about the axis of rotation.

According to one aspect of the description, it may be possible to adjust the position of only one of the guides or of both of the guides depending on the position of the edges.

According to one aspect of the description, the feeding system may comprise motor-driven belts which contribute to feeding the flaps of the web on the corresponding guides.

Preferably, the motor-driven belts are as one with the corresponding guide in the oscillation or in the positioning about the axis of rotation.

According to one aspect of the description, the contact unit comprises a motor-driven belt comprising a branch movable in the web feeding direction and defining the contact for the web and the folding line.

The belt of the contact unit contributes to feeding the web in the folding section.

According to one aspect of the description, the contact unit may oscillate about an axis of rotation which is transversal, preferably orthogonal, to the web feeding line.

The position of the contact unit relative to its own axis of rotation affects web tension which can be set to a predetermined value.

BRIEF DESCRIPTION OF DRAWINGS

Further features and advantages of the folding apparatus according to this description are more apparent in the non-limiting description of an embodiment of it, illustrated in the accompanying drawings, in which.

DETAILED DESCRIPTION OF PREFERRED EMBODIMENTS OF THE INVENTION

Figure 1:
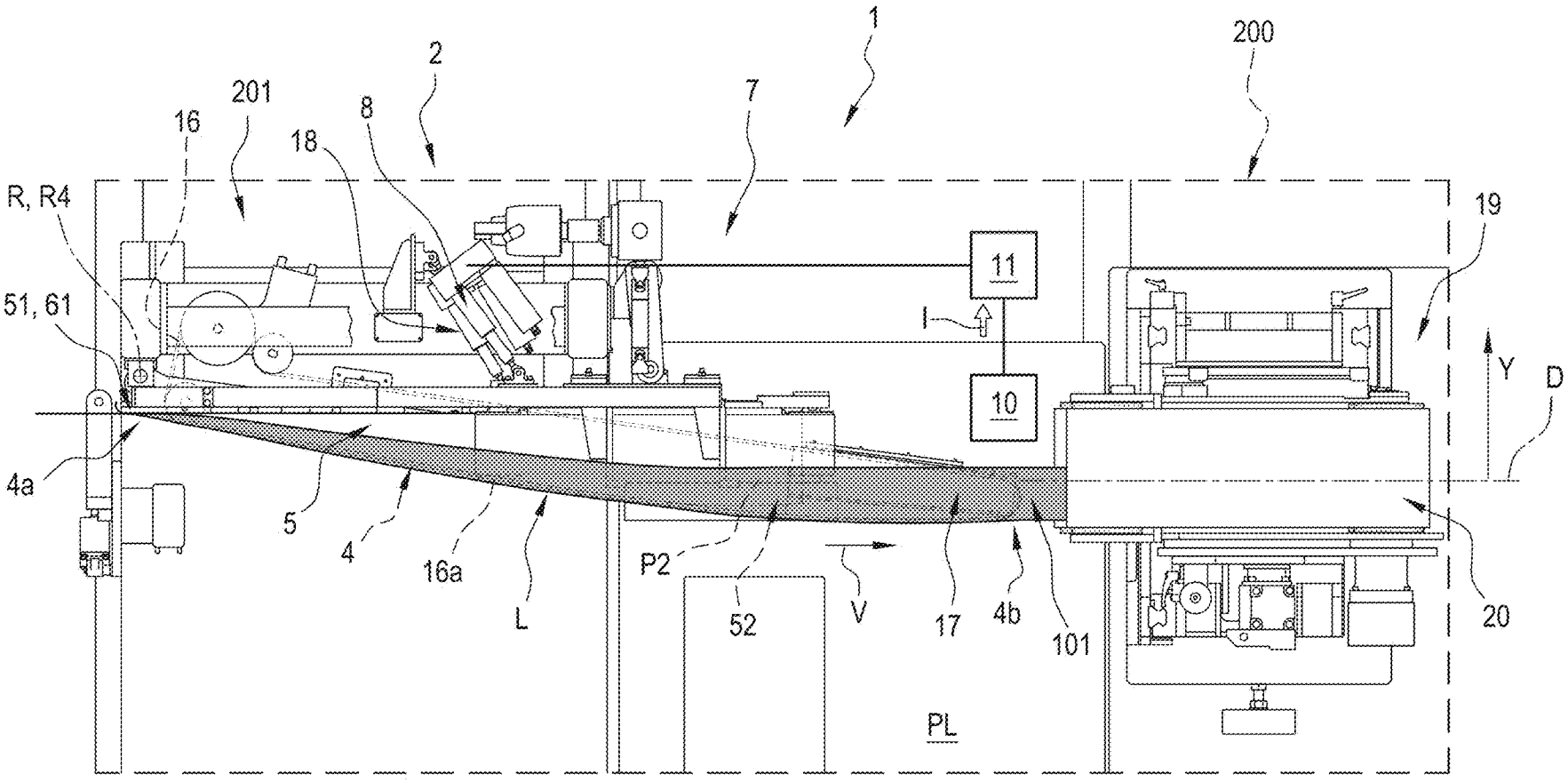
FIG. 1 is a schematic side view partly in bocks and with some parts cut away for greater clarity of a folding apparatus according to this description.

With reference to the accompanying drawings, in particular to FIG. 1, the numeral 1 denotes a folding apparatus for a continuous web 100 being fed in a plant 200 for the production of absorbent hygiene articles which is only partly illustrated.

The web 100 is intended to be folded in two along a longitudinal folding line L parallel to a feeding line D of the continuous web.

The web 100 is for example a composite web comprising a pair of lateral strips which extend along the longitudinal line of the self-same web 100 and are interconnected, for example, by absorbent pads extending along the transversal line of the web and intended to form absorbent articles of the type called "pants"; for simplicity, in the accompanying figures the web 100 is only shown in a very simple form.

Preferably, the web 100 is folded in the folding apparatus 1 in such a way that its longitudinal edges 100*a*, 100*b* are placed in a predetermined position relative to each other, for example substantially superposed.

It should be noticed that, for greater clarity, in the examples illustrated the folded web 100 is shown with the edges 100*a*, 100*b* slightly away from each other at the end of folding, however, the edges 100*a*, 100*b* may be substantially superposed even based on the thicknesses of the web 100.

The apparatus 1 comprises a folding section 2 and, preferably, a feeding system 3 for feeding the folded continuous web 100 which is, at least partly, located downstream of the folding section 2 according to a web feeding direction V.

The system 3 comprises, for example, opposing rollers, not illustrated, which are substantially known and feed or contribute to feeding of the web 100 along the production plant.

The system 3 is not necessarily part of the apparatus 1 and may be located in any part along the plant and is used, for folding purposes, to make the web pass in the section 2.

In the embodiment illustrated, the folding section 2 comprises a contact unit 4 for the web 100.

The unit 4 extends mainly according to the feeding line D of the continuous web 100 and defines the folding line L.

The unit 4 has a first end 4*a* and a second end 4*b* which is located downstream of the first end 4*a* according to the feeding direction V of the web 100.

During its movement along the line D in the direction V, the web 100 is folded in a transversal direction, preferably into a "U" or "V" shape, around the unit 4, that is to say, according to the folding line L.

In the example illustrated, the web 100 has two flaps or portions 101, 102 which are respectively delimited by the folding line L and the first edge 100*a* and by the folding line L and the second edge 100*b*.

Figure 2:
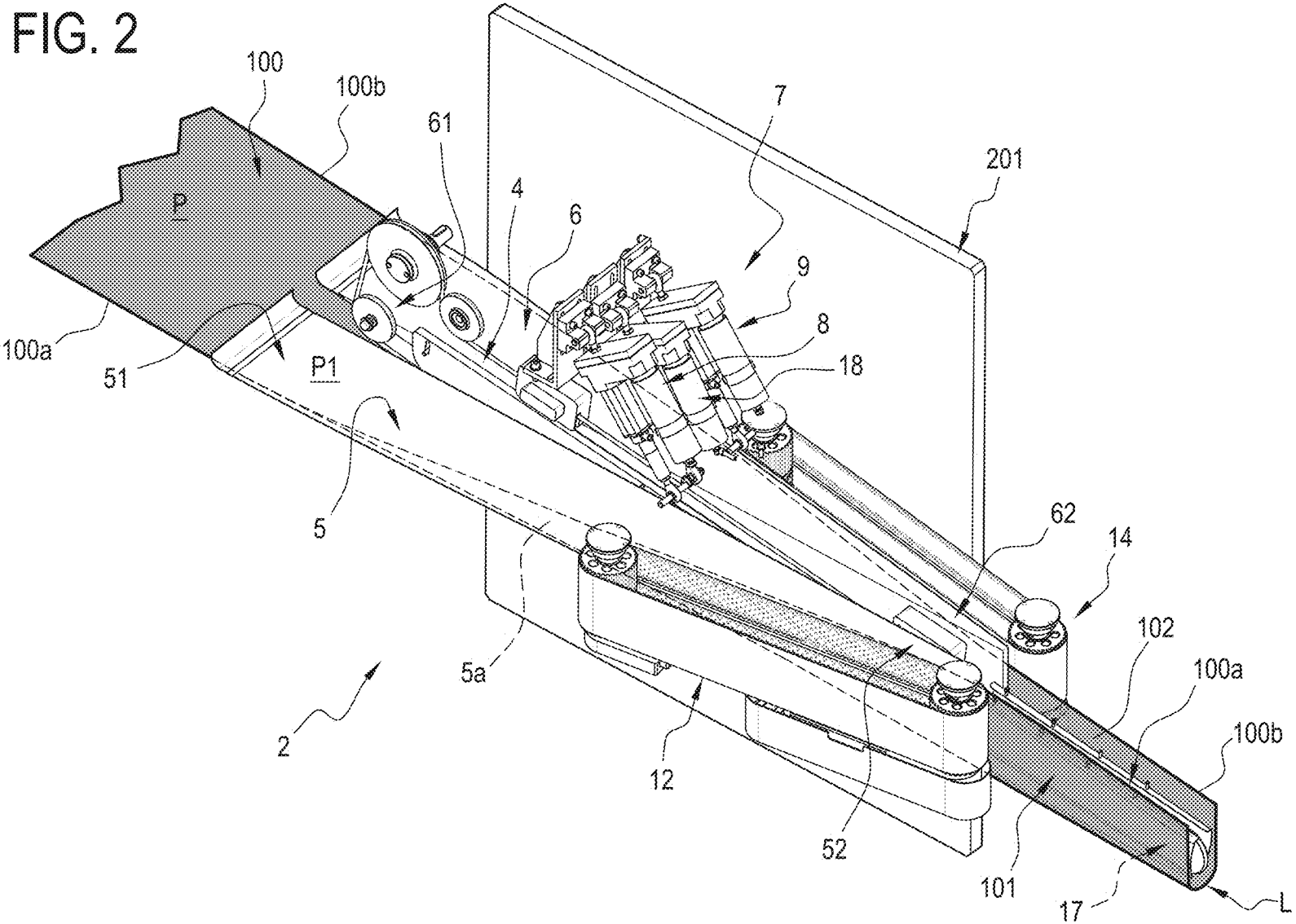
FIG. 2 is a schematic perspective view with some parts cut away for greater clarity of a folding section of the apparatus of FIG. 1.

In particular, the flaps 101, 102 are easily identifiable considering the folded web where they are at an angle to each other and meet at the folding line, for example as illustrated in FIG. 2.

The folding section 2 comprises a first and a second guide 5, 6 for the continuous web which are located on opposite sides of the contact unit 4.

The guides 5, 6 extend mainly according to the line D and, preferably together with the unit 4, cause the folding of the web 100 during feeding.

The guide 5 has a sliding surface 5*a* for the web 100 and the guides 6 has a sliding surface 6*a* for the web 100.

In the example illustrated, the flap 101 at least partly slides in contact with the surface 5*a* whilst the flap 102 at least partly slides in contact with the surface 6*a* along the section 2.

The flap 101 and the flap 102 remain substantially separated by the contact unit 4 as they pass through the section 2.

Preferably, the layout of the folding section 2 ensures that the guides 5 and 6 are above the web 100 when it is not folded or between the two flaps 101, 102 of the web when it is folded.

In alternative embodiments not illustrated, the folding section 2 is substantially inverted, observing FIG. 1 for example, and the web 100 is fed on top of the guides 5, 6.

The sliding surface 5*a* of the first guide 5 extends in a helical fashion and has an infeed section 51 and an outfeed section 52 which is downstream of the infeed section according to the feeding direction V of the web 100.

As illustrated, the infeed section 51 of the surface 5*a* lies in a first plane P1.

The plane P1 is preferably parallel to a lying plane P of the web 100 upstream of the folding section 2 according to the feeding direction of the web 100.

The outfeed section 52 of the surface 5*a* lies in a second plane P2 which is transversal to the plane P1 in such a way as to form the "U" or "V" shaped fold in the web 100.

In particular, the surface 5*a* shaped in this way causes a substantially 90° rotation of the flap 101 about the folding line L.

Preferably the plane P2 is substantially orthogonal to the plane P1.

The sliding surface 6*a* of the second guide 6 extends in a helical fashion and has an infeed section 61 and an outfeed section 62 which is downstream of the infeed section according to the feeding direction V of the web 100.

As illustrated, the infeed section 61 of the surface 6*a* lies in a third plane P3.

The plane P3 is preferably parallel to the lying plane P of the web 100 upstream of the folding section 2 according to the feeding direction of the web 100.

The outfeed section 62 of the surface 6*a* lies in a fourth plane P4 which is transversal to the plane P3 in such a way as to form the "U" or "V" shaped fold in the web 100.

In particular, the surface 5*a* shaped in this way causes a substantially 90° rotation of the flap 102 about the folding line L.

Preferably the plane P4 is substantially orthogonal to the plane P3.

Advantageously, the web 100 is not in a folded configuration upon entering the sections 51 and 61 and it has been folded when it exits the sections 52, 62.

In the preferred embodiment illustrated, the planes P1 and P3 coincide with each other and the planes P2, P4 are substantially orthogonal to the plane P and converge in the feeding direction V of the web 100.

The surfaces 5*a*, 6*a* converge at the respective outfeed sections 52, 62 in such a way that downstream of the section 2 the web 100 is folded.

In a preferred embodiment, the surfaces 5*a*, 6*a* are specular relative to a lying plane PL of the folding line which is preferably perpendicular to the plane P and parallel to the planes P2, P4.

With reference to FIG. 1, the plane PL corresponds to the plane of FIG. 1 itself.

In order to adjust the relative position of the edges 100*a*, 100*b* of the web 100 once the web is folded, the apparatus 1 comprises a related adjusting system 7.

The guide 5 and the guide 6 pivot at a frame 201 of the above-mentioned production plant and are rotatable about an axis of rotation R which is transversal, in particular orthogonal, to the feeding line D of the web 100.

The adjusting system 7 comprises a first and a second actuator 8, 9 which are connected respectively to the guide 5 and to the guide 6 for changing their position about the axis R.

The adjusting system 7 comprises at least one position sensor, schematically illustrated with a block 10 in FIG. 1, for checking the relative position of the edges 100*a*, 100*b* downstream of the folding section 2, for example in a vertical plane according to an axis Y.

For simplicity reference is made to the case in which the edges 100*a*, 100*b* must be substantially superposed, meaning any desired and predetermined relative position to be reached following the folding.

For example, the sensor 10 is of the optical type and, for example, of the fork type.

The adjusting system 7 comprises a computerised control unit, schematically illustrated with a block 11, in communication with the sensor 10 and with the actuators 8, 9.

The unit 11 is configured for moving, by means of the actuators 8, 9, the guides 5, 6 about the axis R depending on a piece of information I about the relative position of the edges 100*a*, 100*b* as received from the sensor 10.

In alternative embodiments not illustrated, in order to adjust the position of the edges 100*a*, 100*b* only one of the guides 5, 6 is movable about the axis R of rotation, controlled by the corresponding actuator which is controlled by the unit 11.

In the embodiment illustrated, the feeding system 3 for the web comprises motor-driven belts, for example of the type looped around at least two rollers one of which is motor-driven, the belts being located at the guides 5, 6 for promoting feeding of the web 100 at the guides.

In the example illustrated, the feeding system 3, substantially at the folding section 2, comprises a first motor-driven belt 12 alongside the sliding surface 5*a* of the first guide 5.

The belt 12 comprises a branch 12*a* movable in the feeding direction of the continuous web 100 and facing the surface 5*a*.

Together with the surface 5*a* the branch 12*a* delimits a passage 13 for the continuous web in which the flap 101 passes, if necessary fed by the belt 12 by means of the branch 12*a*.

Figure 3:
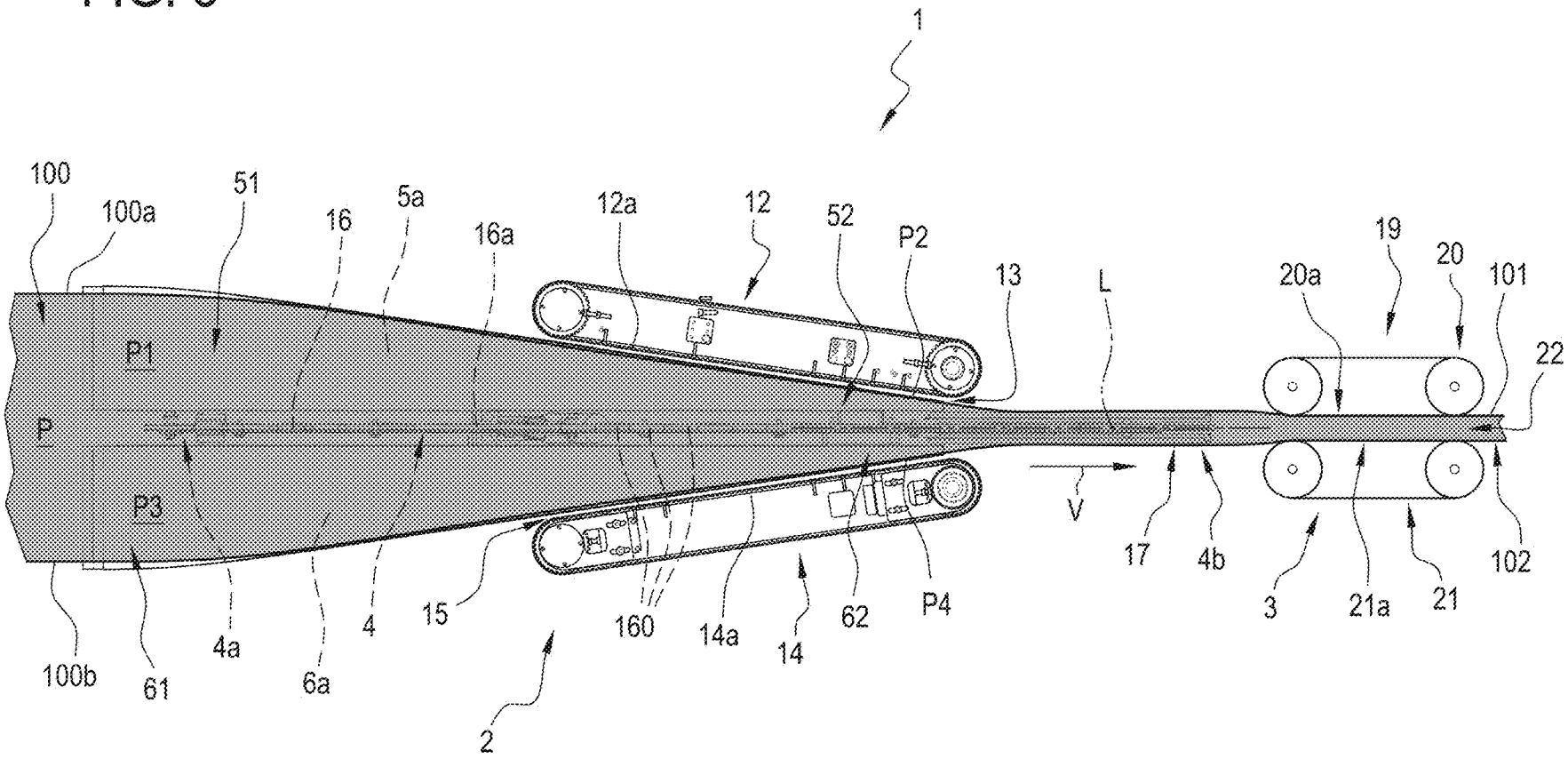
FIG. 3 is a bottom plan view of a detail of the apparatus of FIG. 1.

In FIG. 3 for clarity a space is visible between the branch 12*a* and the flap 101; preferably, when the contribution of the belt 12 is necessary for feeding the web in the section 2, the branch 12*a* is, in use, in contact with the web 100.

Substantially at the folding section 2, the feeding system 3 comprises a second motor-driven belt 14 alongside the sliding surface 6*a* of the second guide 6.

The belt 14 comprises a branch 14*a* movable in the feeding direction of the continuous web 100 and facing the surface 6*a*.

Together with the 6*a* the branch 14*a* delimits a passage 15 for the continuous web in which the flap 102 passes, if necessary fed by the belt 14 by means of the branch 14*a*.

In FIG. 3 for clarity a space is visible between the branch 14*a* and the flap 102; preferably, when the contribution of the belt 14 is necessary for feeding the web in the section 2, the branch 14*a* is, in use, in contact with the web 100.

In a preferred embodiment, the belt 12 is located substantially at the outfeed section 52 of the surface 5*a* in such a way that the branch 12*a* accompanies web 100, in particular the flap 101, at the outfeed of the section 2.

In a preferred embodiment, the belt 14 is located substantially at the outfeed section 62 of the surface 6*a* in such a way that the branch 14*a* accompanies the web 100, in particular the flap 102, at the outfeed of the section 2.

In a preferred embodiment, the belts 12, 14 are as one respectively with the guide 5 and with the guide 6 in the motion about the axis R of rotation.

For example, the apparatus 1 comprises a single supporting structure which supports the guide 5 and the belt 12 and is rotatable about the axis R and a single supporting structure which supports the guide 6 and the belt 14 and is rotatable about the axis R.

In this case, the actuators 8, 9 are fastened and operational respectively on the first supporting structure and on the second supporting structure.

In a preferred embodiment, the above-mentioned contact unit 4 comprises a corresponding motor-driven belt 16 which operates in conjunction with the web feeding system 3 or is part of it.

The belt 16 is of the substantially known type, looped around at least two rollers one of which is motor-driven.

The belt 16 comprises a branch 16*a* movable in the feeding direction V of the web 100 located at the folding line L which is at least partly defined by the self-same branch 16*a*; in use the web 100 is folded into a "V" or "U" shape around the branch 16*a*.

By means of the branch 16*a* the belt 16 promotes feeding of the web 100 in the folding section 2.

In the example illustrated, the branch 16*a* is preferably guided by a train of rollers 160 which preferably extends along the whole section 2.

The contact unit 4, and if necessary the branch 16*a* if the belt 16 is provided, preferably extends from the infeed sections 51, 61 of the guides 5, 6 at least as far as the outfeed sections 52 and 62 of the guides.

In the example illustrated, the unit 4 extends beyond the outfeed sections 52 and 62 in the feeding direction V of the web 100, that is to say, the end 4*b* is located downstream of the sections 52, 62 according to the feeding direction V.

In order to facilitate sliding of the web 100 once it has been folded, the unit 4 preferably comprises a guard 17 at least in the portion which extends beyond the guides 5, 6 in the direction V.

In a preferred embodiment, the unit 4 pivots at the frame 200 of the plant and is movable about an axis R4 of rotation.

In the example illustrated, the axis R4 coincides with the axis R of rotation of the guides 5, 6.

The section 2 comprises an actuator 18 operatively acting on the unit 4 for adjusting its position about the axis R4.

That adjustment allows the tension of the web 100 to be set during folding, allowing improved control of it. The position of the unit 4 is for example determined by the type of material of the web 100 or by the composition of it.

In the example illustrated, the unit 4 pivots at the frame 100 substantially at its first end 4*a*.

In one embodiment, the apparatus 1 comprises, downstream of the folding section 2 according to the feeding direction V of the web 100, a station 19 for stabilising the fold made in the web.

In the example illustrated, the station 19 comprises a first and second looped belt 20, 21, which are motor-driven and located on opposite sides of the web 100 feeding path.

The belt 20 comprises a branch 20*a* movable in the direction V parallel to the web 100 and the belt 21 comprises a branch 21*a* movable in the direction V parallel to the web 100.

The branches 20*a* and 21*a* delimit a channel 22 for passage of the folded web 100 and contribute to feeding the self-same web 100.

In that sense, the belts 20, 21 may be considered part of the feeding system 3.

The relative position of the branches 20*a* and 21*a* is also set in such a way as to stabilise the fold made in the section 2 upstream of the station 19, that is to say, to stabilise the folded web 100, for example by compressing it, and prepare it for subsequent processing in the production plant.

The invention claimed is:

1. A folding apparatus for a continuous web being fed in a plant for production of absorbent hygiene articles to be folded into a "V" or "U" shape in a first longitudinal portion and in a second longitudinal portion according to a longitudinal folding line parallel to a feeding line of the continuous web, said folding apparatus comprising:

a folding section comprising:

a contact unit for the continuous web extending along the feeding line of the continuous web and defining the longitudinal folding line;

a first guide having a first sliding surface for the continuous web and a second guide having a second sliding surface for the continuous web, the first guide and the second guide being positioned on opposite sides of the contact unit, wherein the first sliding surface and the second sliding surface of extend in a helical fashion, wherein the first sliding surface and the second sliding surface extend along said feeding line, wherein the first sliding surface and the second sliding surface each have a respective infeed section, where the web is not folded, and a respective outfeed section, positioned downstream of the respective infeed section according to a web feeding direction, where the continuous web is folded in two and has the first longitudinal portion and the second longitudinal portion set at an angle to each other, wherein the infeed sections of the first and the second sliding surfaces are substantially coplanar, wherein the outfeed section of the first sliding surface and the outfeed section of the second sliding surface are transversal to the respective infeed sections and at least partly converging in the web feeding direction;

wherein at least one of said first guide or said second guide is movable about an axis of rotation transversal to the feeding line, an adjusting system for a relative position of longitudinal edges of the continuous web once the continuous web has been folded, said adjusting system comprising:

at least one position sensor for checking a relative position of the longitudinal edges of the continuous web once the continuous web has been folded, at least one actuator connected to the at least one of said first guide or said second guide for moving the at least one of said first guide or said second guide about the axis of rotation, a computerized control unit in communication with the at least one position sensor and said at least one actuator and configured for moving, via said at least one actuator, said at least one of said first guide or said second guide about the axis of rotation depending on a significant piece of information about the relative position of the longitudinal edges as received from the at least one position sensor.

2. The folding apparatus according to claim 1, wherein said first and second sliding surfaces are specular relative to a lying plane of the longitudinal folding line.

3. The folding apparatus according to claim 1, and further comprising a feeding system for the folded continuous web located downstream of the folding section according to the web feeding direction.

4. The folding apparatus according to claim 3, wherein the feeding system for the continuous web comprises a first motor-driven belt alongside the first sliding surface of the first guide and comprising a first branch movable in the web feeding direction facing the first sliding surface and together with the first sliding surface delimiting a first passage for the continuous web, said feeding system also comprising a second motor-driven belt alongside the second sliding surface of the second guide and comprising a second branch movable in the web feeding direction facing the second sliding surface and together with the second sliding surface delimiting a second passage for the continuous web, said continuous web in use having the first longitudinal portion moved by the first branch and passing through the first passage and the second longitudinal portion, separated from the first longitudinal portion by the longitudinal folding line, moved by the second branch and passing through the second passage.

5. The folding apparatus according to claim 1, wherein said contact unit comprises a third motor-driven belt having a third branch movable in the web feeding direction at the longitudinal folding line, said third motor-driven belt operating in conjunction with a feeding system for the web for feeding the continuous web as the continuous web is being folded.

6. The folding apparatus according to claim 1, wherein said contact unit extends along said feeding line at least from said respective infeed sections to said respective outfeed sections of said first and second sliding surfaces.

7. The folding apparatus according to claim 1, wherein said contact unit is movable about a second axis of rotation transversal to the feeding line, said folding apparatus comprising a third actuator operatively active on the contact unit for adjusting a position of the contact unit about the second axis of rotation.

8. The folding apparatus according to claim 1, wherein the outfeed section of the first sliding surface and the outfeed section of the second sliding surface are orthogonal to the respective infeed sections.

* * * * *